US006887143B2

(12) United States Patent
Bocka et al.

(10) Patent No.: US 6,887,143 B2
(45) Date of Patent: May 3, 2005

(54) SANDING HAND MACHINE TOOL

(75) Inventors: Sabine Bocka, Leinfelden-Echterdingen (DE); Uwe Engelfried, Ostfildern (DE)

(73) Assignee: Robert Bosch GmbH, Stuttgart (DE)

( * ) Notice: Subject to any disclaimer, the term of this patent is extended or adjusted under 35 U.S.C. 154(b) by 12 days.

(21) Appl. No.: 10/398,059

(22) PCT Filed: Jun. 27, 2002

(86) PCT No.: PCT/DE02/02345

§ 371 (c)(1),
(2), (4) Date: Apr. 1, 2003

(87) PCT Pub. No.: WO03/015986

PCT Pub. Date: Feb. 27, 2003

(65) Prior Publication Data

US 2004/0033767 A1 Feb. 19, 2004

(30) Foreign Application Priority Data

Aug. 10, 2001 (DE) ..... 101 39 546

(51) Int. Cl.[7] ..... B24D 17/00
(52) U.S. Cl. ..... 451/359; 451/514; 451/519
(58) Field of Search ..... 451/359, 514, 451/344, 353, 515–519

(56) References Cited

U.S. PATENT DOCUMENTS

| | | | | | |
|---|---|---|---|---|---|
| 2,242,545 | A | * | 5/1941 | Randolph | 451/516 |
| 2,735,241 | A | * | 2/1956 | Hilgers | 451/356 |
| 2,749,679 | A | * | 6/1956 | Anton | 451/518 |
| 2,914,889 | A | * | 12/1959 | Mosbacher | 451/516 |
| 3,267,622 | A | * | 8/1966 | Lars | 451/516 |
| 4,330,964 | A | * | 5/1982 | Martinez | 451/357 |

FOREIGN PATENT DOCUMENTS

GB 2 322 582 A 9/1998

* cited by examiner

*Primary Examiner*—Hadi Shakeri
(74) *Attorney, Agent, or Firm*—Michael J. Striker

(57) ABSTRACT

A power grinder, in particular an oscillating grinder (10), includes a platelike grinding sheet holder (14), on whose working face (15) a grinding sheet (16) can be braced. Secure clamping of the grinding sheet and easy changing of the grinding sheet are provided, because the grinding sheet (16) can be inserted between the clamping jaw (22) and the grinding sheet holder (14)—counter to the elastic prestressing of the clamping jaw (22)—and is firmly held increasingly strongly counter to the insertion direction in proportion to the tensile force engaging it.

7 Claims, 6 Drawing Sheets

SANDING HAND MACHINE TOOL

BACKGROUND OF INVENTION

The invention relates to a power grinder, in particular oscillating grinder with a platelike grinding sheet holder.

From British Patent GB 23 22 582, a pivotable pincer with a grinding plate for holding grinding sheets is known; the grinding sheet is braced with their back against the underside of the grinding plate and can be firmly clamped to its top.

For firmly clamping the grinding sheet, the user has to use both hands, and if at all possible the power tool should be placed on a firm support. One grinding sheet end has to be introduced with one hand into a slot between an opened clamping jaw and the top side of the grinding sheet holder, while the clamping jaw has to be kept open in the release position with the other hand until the grinding sheet end has been introduced. Once the clamping jaw is let go, it then closes by spring force and assumes its clamping position, in which it firmly clamps the grinding sheet end, on a skewed support face on the top of the grinding sheet holder. In the process, the grinding sheet is automatically retightened to a certain extent, because the rotatably suspended clamping jaw rolls outward along the skewed support face and carries the grinding sheet end along with it.

With the other grinding sheet end, the procedure until now was the same, but the clamping force and the retightening force were limited.

SUMMARY OF THE INVENTION

The power grinder of the invention has the advantage over the prior art that equipping it with new grinding sheets can be accomplished with only one hand, more easily and faster than in the tools known before. Also, because the clamping means allows the grinding sheet to enter in a preferential direction but does not release it in the opposite direction unless particular action is taken, it is possible for the grinding sheet to be clamped to the grinding sheet holder solidly and without play using only one h and. One-handed operation here means In fact only a single hand has to be active in order to insert and fix the grinding sheet. The other hand can rest in the meantime or fix the power tool, for instance pressing against a support.

Because the outer contour of the clamping jaw curves outward with an increasing radius of curvature, and in particular within the range of self-locking, so that the clamping force increases in proportion to the tensile force that tends to loosen the grinding sheet, the clamped grinding sheet is securely held firmly regardless of its thickness; that is, both thin and thick grinding sheets are held equally securely. Because of the firm clamping of the grinding sheet, the play between it and the grinding sheet holder is limited. Thus the oscillating grinding motion of the grinding sheet holder is also transferred virtually without slip to the grinding sheet, so that the grinding sheet can effectively engage a workpiece so as to grind it.

Because the clamping jaw has an outer contour whose greatest spacing from the pivot axis is less than the spacing between the pivot axis and the top side of the grinding sheet holder, and because the clamping jaw, toward the edge of the grinding sheet holder, braces itself in elastically rotationally prestressed fashion on one side of the grinding sheet holder, a high clamping force between the clamping jaw and the top side of the grinding sheet holder is established automatically, with a simple design of the clamping means, and a servo-clamping effect, which means that with increasing tensile force on the sandpaper counter to the insertion direction, the clamping force becomes greater and grater. As a result, the sandpaper can be clamped firmly practically up to the tearing limit without being able to come loose by itself.

Because the clamping jaw, to release the fastened grinding sheet, is movable counter to the clamping direction by means of a pushbutton, it is especially simple to release the grinding sheet end from the power grinder.

Because the clamping jaw comprises elastic, rubberlike material, the servo effect is reinforced for increasing clamping of the grinding sheet.

The servo effect is furthermore reinforced by the provision that the outer contour of the clamping jaw is progressively curved in saber-like fashion.

A further advantage is that after the grinding sheet has been clamped, its tensing or tautening can be increased simply by pushing it onward into the clamping slot; once a grinding sheet end has been inserted, the clamping device does not let it go again even if great force counter to the insertion direction is exerted, unless a release switch is actuated first. The farther the grinding sheet end is slipped under the clamping jaw, the greater the clamping surface area and thus the more forceful the clamping.

BRIEF DESCRIPTION OF THE DRAWINGS

One exemplary embodiment of the invention is explained in further detail in the ensuing description in conjunction with the drawing.

Shown are

DETAILED DESCRIPTION OF THE PREFERRED EMBODIMENT

Figure 1:
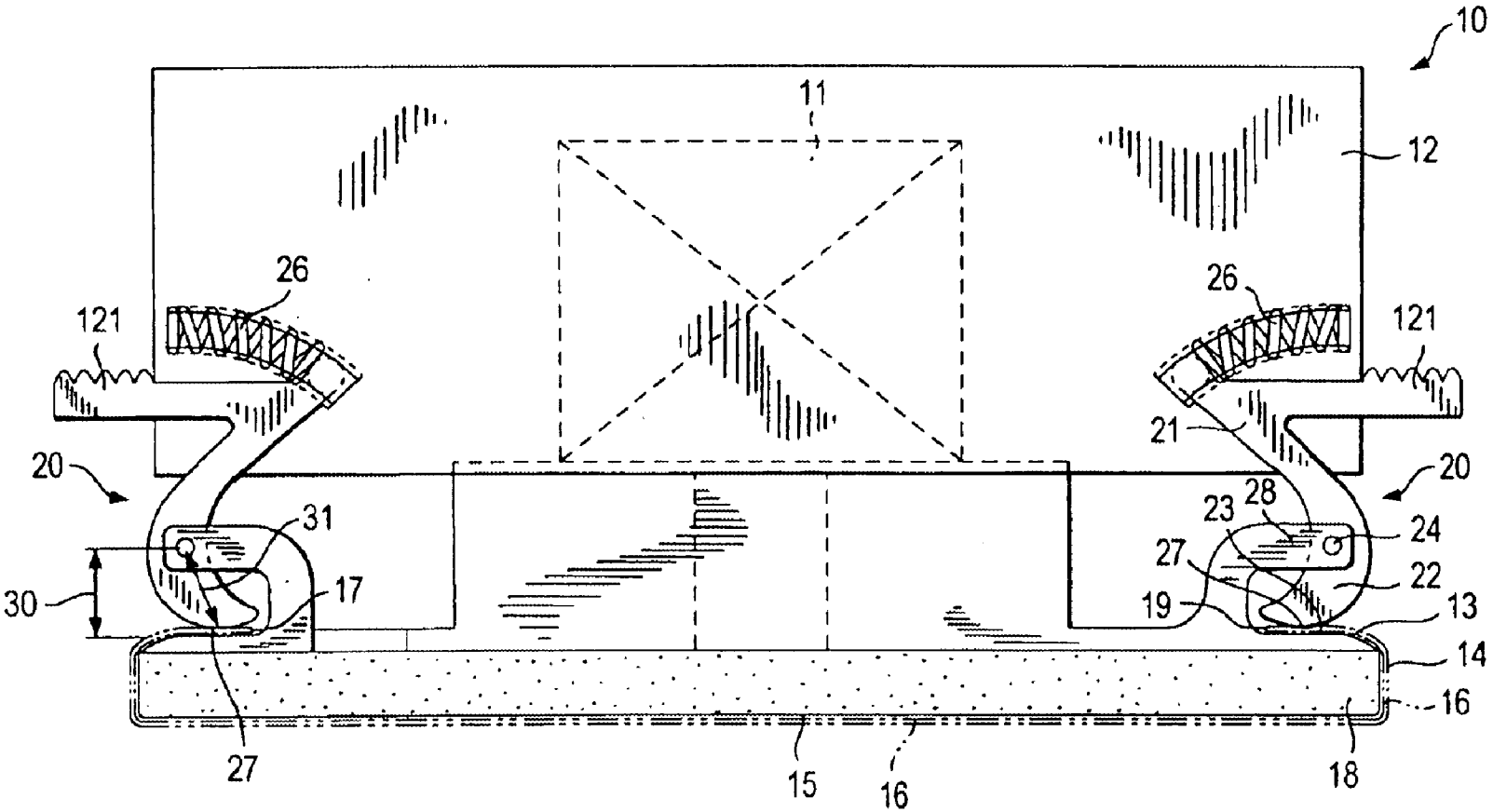
FIG. 1, a schematic side view of the power grinder of the invention.

FIG. 1 is a schematic side view of the power grinder 10 with a rectangular housing 12 that at the same time serves as a grip for holding and guiding the power grinder 10.

A motor 11 disposed in the housing 12 serves to drive a platelike grinding sheet holder 14, which is disposed on the underside of the housing 12, to reciprocate. On its underside 15 serving as a working face, the grinding sheet holder 14 carries a grinding sheet 16, which is braced with its back side on the grinding sheet holder 14, or on its grinding pad 18.

Clamping means embodied as two-armed clamping levers 20 are disposed on opposite sides on the top 13 of the grinding sheet holder 14. The clamping levers 20 have a swinging arm 21 above a pivot shaft 24 and a clamping jaw 22 below, which latter clamping jaw is braced with a saber-shaped curved outer contour 27 on a detent face 23 on the top 13 of the grinding sheet holder 14. The pivot shaft 24 is seated on a bearing block 28 on the top of the grinding sheet holder 14.

Between the top of each swinging arm 21 and an abutment, not identified by reference numeral, in the housing 12, a compression spring 26 is braced; it tends to pivot the respective clamping levers 20 outward, presses the clamping jaw 22 against the detent face 23, and thus firmly clamps the grinding sheet end 17, 19.

The swinging arm 21 also carries a protruding angle bracket, acting as a toggle switch 121, with which it can be pivoted by finger pressure—counter to the compression spring 26—in such a way that the clamping jaw 22 lifts from the detent face 23, in the course of which the gap between the outer contour 27 of the clamping jaw 22 and the detent face 23 enlarges, and the grinding sheet 16 can be readily removed.

In both clamping levers 20, the spacing 30 between the pivot shaft 24 and the detent face 23 is less than the spacing 31 between the pivot shaft 24 and the outermost point of the outer contour 27, so that in the position prestressed by the spring 26, the tensing jaw 21 comes to a stop—up to the range of self-locking—against the detent face 23 on the top 13 of the grinding sheet holder 14. In a servo-effectlike way, this reinforces the clamping force on the grinding sheet 16 counter to the insertion direction for corresponding displacement forces that tend to release the grinding sheet 16.

On the other hand, the compression spring 26 is prestressed only slightly, such that the grinding sheet 16 from outside, by slight pressure against the outer contour 27 of the clamping jaw 22, displaces the clamping jaw counter to the compression spring 26 and counter to the tensing direction, creating the gap required for the insertion on its own, and can easily be displaced inward and onward easily with one hand. The clamping jaw 22 has at least one outer layer of elastic, rubberlike material with a high coefficient of friction, which largely restricts a relative motion between the grinding sheet 16 and the clamping jaw 22.

For equipping the power grinder 10 with a grinding sheet, the tool must be held firmly with one hand on the housing 12. With the other hand, one grinding sheet end 17 should be inserted first at the first clamping lever 20 in the manner described and then locked. Then the second grinding sheet end 19 can be introduced at the other clamping lever 20 in the same way and locked, and by sweeping the hand along the grinding sheet 16, it can be made taut, and its ends 17, 19 can be inserted farther between the clamping jaws 22 and the detent faces 23, without the ends emerging again if let go and without any letup in the tension on the grinding sheet 16. As a result, with comparatively little effort, taut and firm clamping of the grinding sheet 16 to the pad 18 or to the grinding sheet holder 14 is possible.

Figure 2:
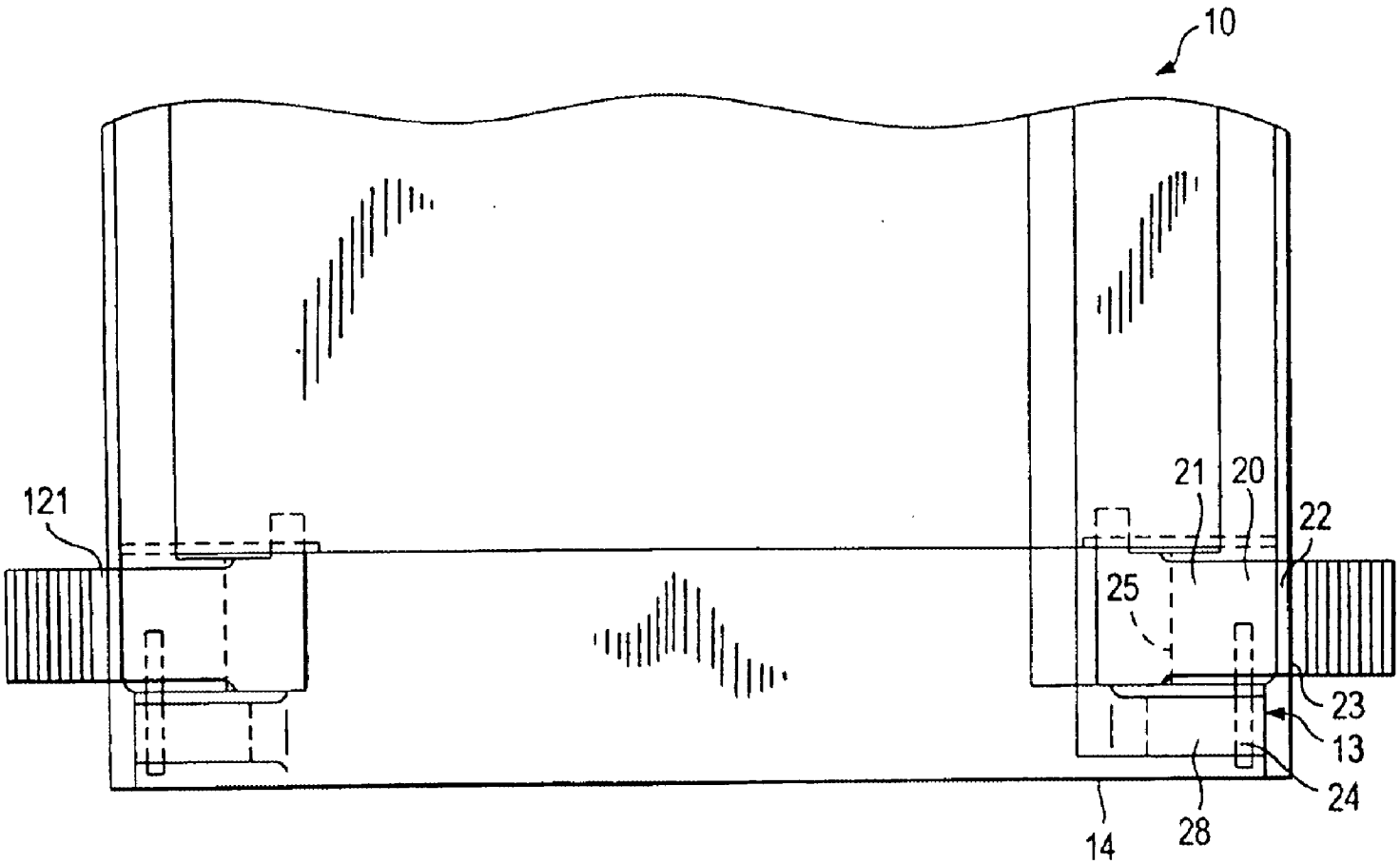
FIG. 2, a plan view from above on the clamping means of the power grinder.
Figure 4:
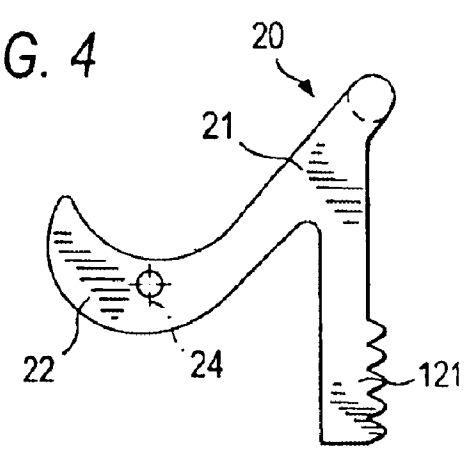
FIG. 4, the saber-like outer and inner contours of the clamping jaw.
Figure 6:
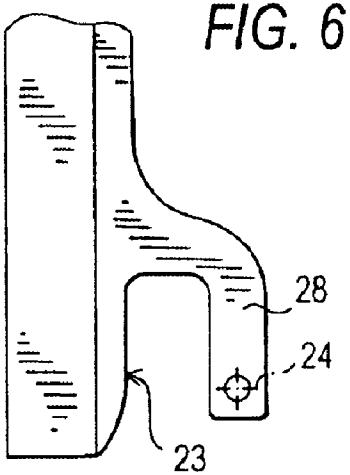
FIG. 6, a side view of FIG. 5.
Figure 3:
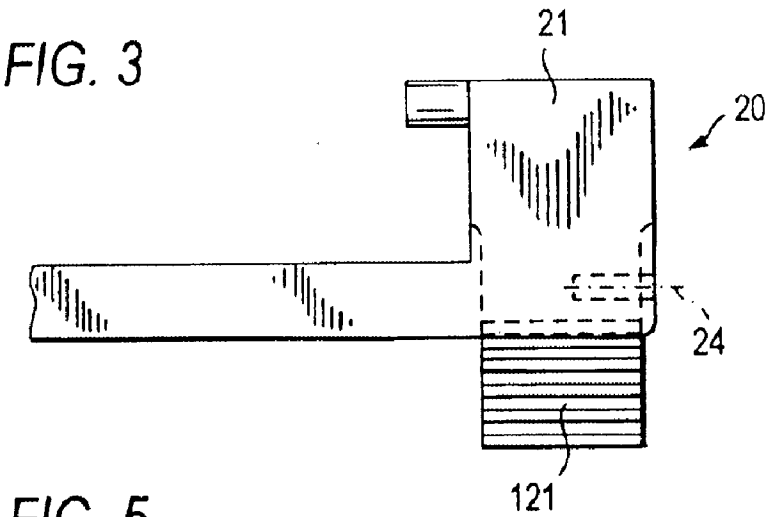
FIG. 3, the detail of a single clamping jaw from above.
Figure 5:
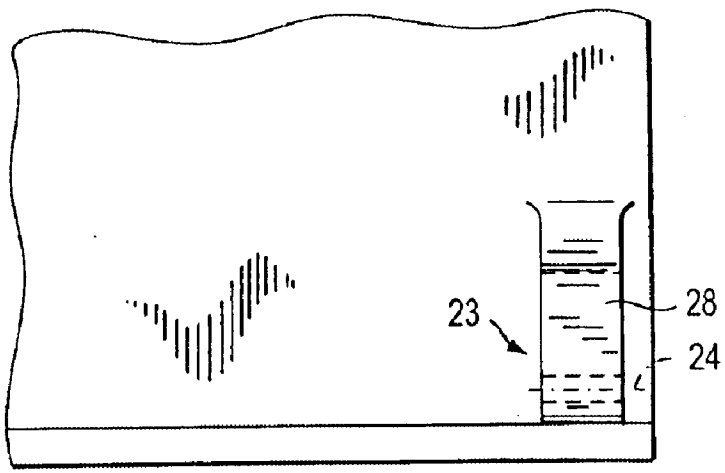
FIG. 5, a plan view on the grinding sheet holder.

FIG. 2 shows a plan view on the power grinder 10 with the details of the clamping means 20, and FIGS. 3–6 show the clamping means, which are described above in conjunction with FIG. 1, in the form of a detail.

Figure 7A:
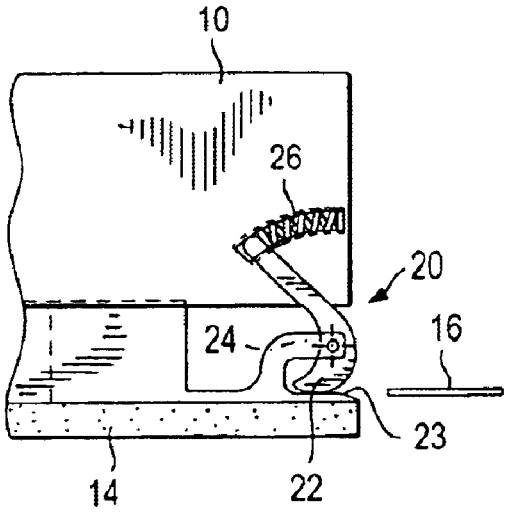
FIGS. 7*a, b, c* and 8*a*, 8*b*, the side view of the clamping means upon insertion and release, respectively, of the grinding sheet.
Figure 7B:
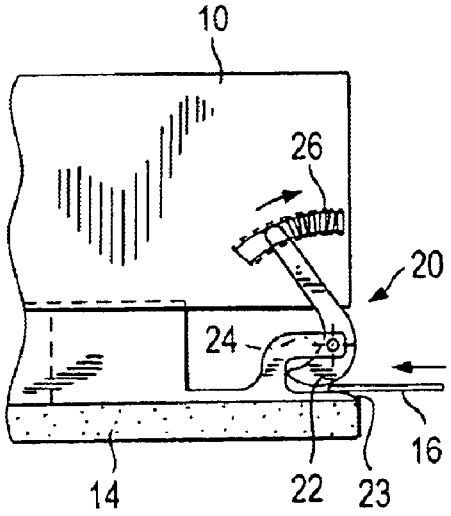
Figure 7C:
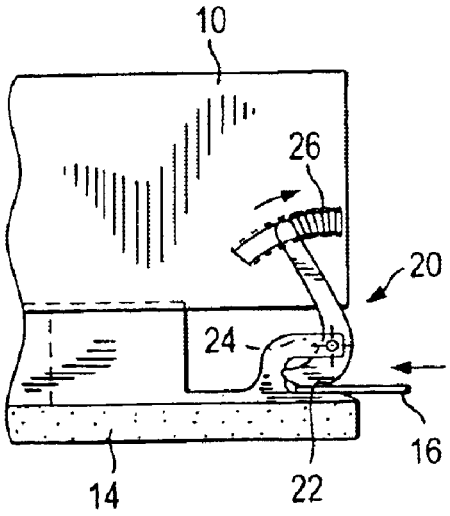

FIG. 7*a* shows the phase of motion of the clamping means before the insertion; FIG. 7*b* shows it upon insertion of the grinding sheet end 19; and FIG. 7*c* shows it after the insertion, in the end position of the grinding sheet once the clamping action has developed. It can be seen from this that for inserting the grinding sheet 16, the grinding sheet end 19 need merely be pressed laterally slightly against the outer contour 27 of the clamping jaw 22, so that a gap that the sheet enters is formed between the clamping jaw 22 and the detent face 23. The clamping lever 20 need not be actuated separately by hand.

Figure 8A:
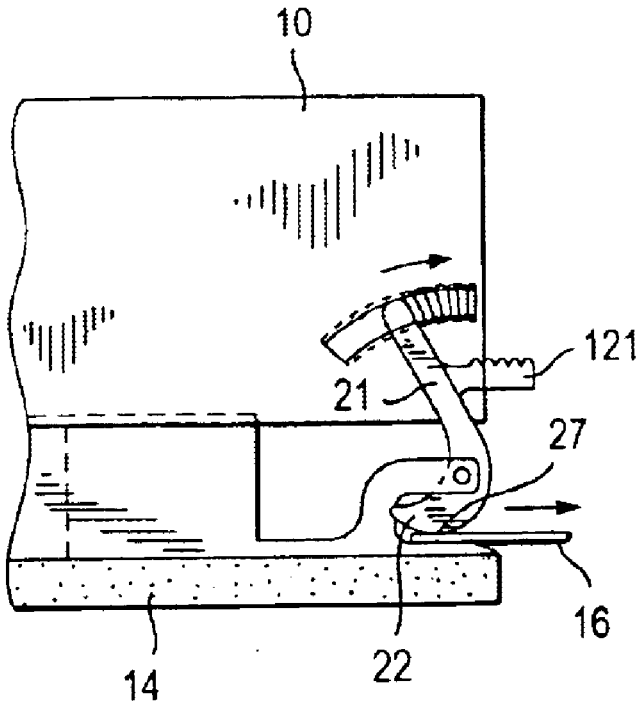
Figure 8B:
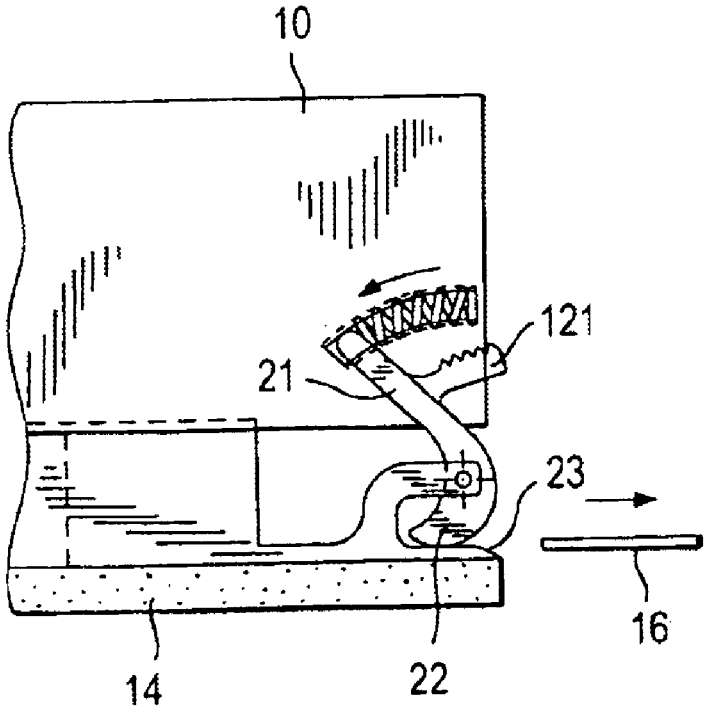

FIGS. 8*a* and 8*b* show the phases of motion of the clamping lever 20 upon removal of the grinding sheet 16; the clamping lever 20 should then be moved clockwise about the pivot shaft 24 by hand, that is, by finger pressure on the switch 121. The clamping jaw 22 then lifts with its outer contour from the grinding sheet 16, or from the detent face 23, in such a way that from the enlarging gap, the grinding sheet end 17, 19 can easily be pulled out, and thus the grinding sheet 16 can easily be released.

Figure 9:
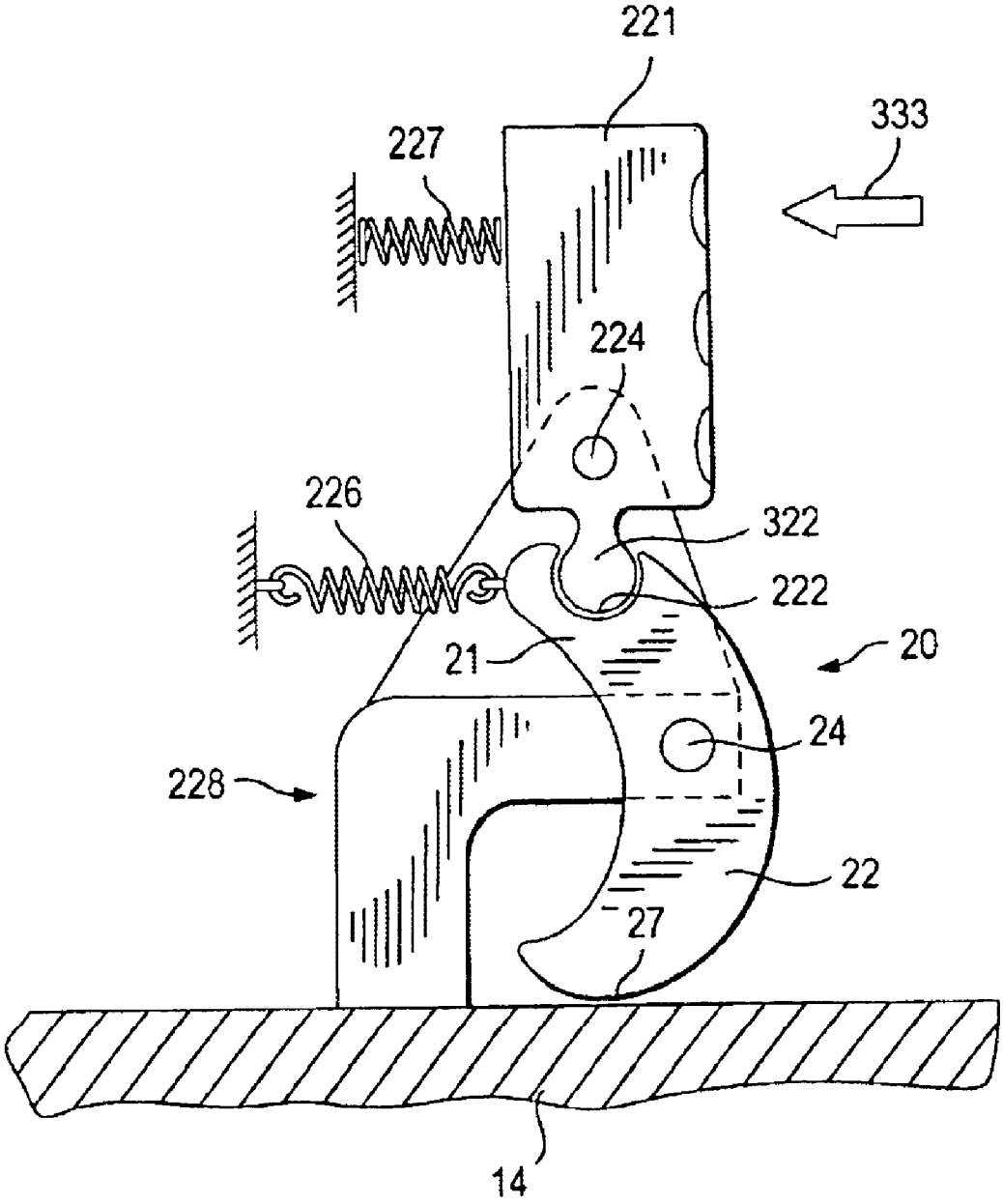
FIG. 9, a basic sketch of a clamping jaw, which can be actuated with a switch, in the power grinder of the invention.

FIG. 9 shows an enlarged view of a clamping lever 20, whose shaft 24 is disposed on a bearing block 228 on the grinding sheet holder 14. The clamping lever 20 has a clamping jaw 22, which can be braced against the detent face 23, and a tension spring 226 engaging the outermost end of the swinging arm 21 tends to pull the clamping jaw 22 toward the detent face 23. On the outermost end, the swinging arm 21 has a ball-type socket 222, which is engaged by a link pin 322 of a switch 221.

The switch 221 can be pivoted in the direction of the directional arrow 333 by finger pressure about a shaft 224 retained on the bearing block 228 and can thus move the clamping lever 20 into its opened position so that a clamped grinding sheet can be removed. To return the switch 221 to its outset position, a compression spring 227 is disposed between the back side of the switch 221 and the housing 12 of the power grinder 10.

What is claimed is:

1. A power grinder (10), comprising:

a grinding sheet holder (14) having the shape of a plate and a working face (15), wherein a grinding sheet (16) is supported on the working face (15);

clamping means disposed on the grinding sheet holder (14) at a pivot shaft (24) on a bearing block (28), wherein opposite grinding sheet ends (17, 19) are firmly held on the grinding sheet holder (14) by said clamping means, the clamping means including a two-armed clamping lever (20) having a swinging arm (21) at one side of said pivot shaft, and a clamping jaw (22) supported pivotably about the pivot shaft at another side thereof bracing the grinding sheet on said grinding sheet holder (14), the clamping jaw being elastically biased towards a clamping direction against which the grinding sheet is insertable between the jaw and the sheet holder, whereby upon motion counter to the insertion direction, the grinding sheet ends are locked by an outer contour (27) of the clamping jaw (22) that extends convexly from the pivot shaft (24) and a detent face (23) of the grinding sheet holder (14).

2. The power grinder of claim 1, wherein said outer contour (27) has an increasing radius of curvature, so that the clamping force increases in proportion to a tensile force seeking to release the grinding sheet (16).

3. The power grinder of claim 1, wherein the grinding sheet (16) is removable by defection of the clamping jaw (22) counter to the clamping direction.

4. The power grinder of claim 1, wherein a greatest spacing of the outer contour (27) of the clamping jaw (22) from the pivot shaft (24) is greater than a vertical spacing between the pivot shat (24) and a top side of the grinding sheet holder (14).

5. The power grinder of claim 1, wherein for releasing the grinding sheet (16), the clamping jaw (22) is movable into a release position counter to the clamping direction by a toggle switch (121).

6. The power grinder of claim 1, wherein the clamping jaw (22) at least partly comprises elastic material.

7. The power grinder of claim 1, wherein the clamping jaw is elastically biased towards a clamping direction by a spring (26) acting on said swinging arm.

* * * * *